US007431168B2

(12) United States Patent
Robinson et al.

(10) Patent No.: US 7,431,168 B2
(45) Date of Patent: Oct. 7, 2008

(54) CLOSURE FOR A RETORT PROCESSED CONTAINER HAVING A PEELABLE SEAL

(75) Inventors: Clayton L. Robinson, Elberfeld, IN (US); Douglas M. Williams, Evansville, IN (US); Randall K. Julian, Newburgh, IN (US); Gary V. Montgomery, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 10/026,161

(22) Filed: Dec. 21, 2001

(65) Prior Publication Data

US 2003/0116524 A1 Jun. 26, 2003

(51) Int. Cl.
*B65D 53/00* (2006.01)
*B65D 41/04* (2006.01)
*B65D 51/16* (2006.01)

(52) U.S. Cl. ..... 215/349; 215/252; 215/329; 215/347

(58) Field of Classification Search ..... 215/329, 215/232, 252, 307, 309; 220/288, 359.2, 220/359.3; 428/35.7
See application file for complete search history.

(56) References Cited

U.S. PATENT DOCUMENTS 1,916,977 A * 7/1933 Gutmann ..... 215/232
3,879,492 A 4/1975 Bontinick
4,280,653 A 7/1981 Elias
4,358,919 A 11/1982 Hirota et al.
4,392,579 A * 7/1983 Uhlig et al. ..... 215/307
4,496,674 A * 1/1985 Ehrhart et al. ..... 523/500
4,625,875 A * 12/1986 Carr et al. ..... 215/232
4,638,913 A 1/1987 Howe, Jr.
4,705,188 A * 11/1987 Rahn ..... 215/307
4,722,447 A * 2/1988 Crisci ..... 215/232
4,754,890 A * 7/1988 Ullman et al. ..... 215/232
4,818,577 A * 4/1989 Ou-Yang ..... 428/36.5
4,842,951 A 6/1989 Yamada et al.
4,881,649 A 11/1989 Hsu et al.
4,894,266 A 1/1990 Bauer et al.
4,896,783 A * 1/1990 Leoncavallo et al. ..... 215/330
4,935,273 A * 6/1990 Ou-Yang ..... 428/35.7
5,002,811 A 3/1991 Bauer et al.

(Continued)

FOREIGN PATENT DOCUMENTS

EP 0 659 655 A1 * 6/1995

(Continued)

*Primary Examiner*—Robin Hylton
(74) *Attorney, Agent, or Firm*—John F. Salazar; Chad D. Bruggeman; Middleton Reutlinger

(57) ABSTRACT

The present development is for a closure which provides a liner for abutting a surface and maintaining an effective pressure against a peelable seal affixed to a container lip as the sealed container is exposed to relatively high temperature and pressure conditions. The liner which abuts a surface of the seal sandwiches the seal between the liner and the container lip. The liner defines a resting thickness at ambient temperature and pressure conditions and is made from a material capable of being compressed to a thickness less than the resting thickness and of recovering to a recovery thickness sufficient to allow the liner to maintain a positive pressure against the seal upon exposure to elevated temperatures, elevated pressure, or a combination of elevated temperature and elevated pressure.

1 Claim, 5 Drawing Sheets

U.S. PATENT DOCUMENTS 5,006,384 A 4/1991 Genske
5,009,323 A * 4/1991 Montgomery et al. ..... 215/252
5,011,719 A 4/1991 Gehrke et al.
5,023,121 A 6/1991 Pockat et al.
5,061,532 A 10/1991 Yamada
5,069,355 A 12/1991 Matuszak
5,071,686 A 12/1991 Genske et al.
5,092,469 A 3/1992 Takata et al.
5,093,164 A 3/1992 Bauer et al.
5,110,642 A 5/1992 Genske
5,151,317 A 9/1992 Bothe
5,160,767 A 11/1992 Genske et al.
5,175,035 A 12/1992 Pinsolle et al.
5,178,293 A 1/1993 Suzuki et al.
5,302,442 A 4/1994 O'Brien et al.
5,447,792 A 9/1995 Brandt et al.
5,492,757 A 2/1996 Schuhmann et al.
5,500,265 A 3/1996 Ambroise et al.
5,533,622 A 7/1996 Stockley, III et al.
5,626,929 A 5/1997 Stevenson
5,723,507 A * 3/1998 Markovich et al. ..... 521/51
5,773,136 A 6/1998 Alder et al.
5,785,195 A * 7/1998 Zwemer et al. ..... 215/329
5,837,369 A 11/1998 Grunberger et al.
5,851,640 A 12/1998 Schuhmann et al.
5,882,789 A 3/1999 Jones et al.
5,925,430 A * 7/1999 Bayer et al. ..... 428/35.1
5,973,077 A 10/1999 Kan et al.
5,992,661 A * 11/1999 Zumbuhl ..... 215/252
5,997,968 A 12/1999 Dries et al.
6,202,871 B1 * 3/2001 Kelly ..... 215/307
6,206,871 B1 * 3/2001 Zanon et al. ..... 604/891.1
6,231,975 B1 5/2001 Kong et al.
6,235,822 B1 * 5/2001 Whetten et al. ..... 524/191
6,265,083 B1 7/2001 Tanizaki et al.
6,276,543 B1 8/2001 German et al.
6,659,297 B2 12/2003 Gregory et al.
2002/0162818 A1 * 11/2002 Williams ..... 215/343

FOREIGN PATENT DOCUMENTS

JP 2001261054 A * 9/2001
WO WO 90/09935 * 9/1990

* cited by examiner

CLOSURE FOR A RETORT PROCESSED CONTAINER HAVING A PEELABLE SEAL

BACKGROUND

The present invention relates to a closure for a closure container that has a peelable seal and that is sterilized using a retort process. The closure causes the seal to maintain a positive pressure against a container lip as the container undergoes sterilization by retort processing thereby minimizing the risk of leakage under the seal.

In recent years, packaged products which are room temperature storage stable yet ready-to-use upon opening, i.e. they require no cooking or heating before use, have become extremely popular with the consumer. For many food products, this trend requires only minor packaging changes, such as modifying the package size to be consistent with the anticipated consumer use pattern. However, for products prone to bacterial contamination and spoilage, such as milk-based beverages, soups, and many other low acid food products, this trend presents some major packaging challenges. For example, milk-based and low acid food products need to be sterilized to reduce the initial viable bacterial concentration in a product, thereby reducing the rate at which the product will spoil and lengthening the product's shelf-life. One procedure for reducing the viable bacterial concentration is sterilization by retort processing. In the retort process, a chilled or ambient temperature product is poured into a container and the container is sealed. The container may be sealed by melding two sections of the container material together, such as by heat-sealing a seam on a pouch, or the container may be sealed by bonding a seal to the lip of the container, such as by induction sealing a foil-lined seal to a barrier polymer material bottle neck. The filled package is then sterilized at high temperature in a high pressure water bath. In a typical commercial production rate retort process, the package is heated from an ambient temperature of about 75° F. to a sterilizing temperature in the range of from about 212° F. to about 270° F. As the exterior surface of the package is heated, the package contents are heated and the internal (vapor) pressure increases. By concurrently, submerging the package in the water bath, a counteracting external pressure increase is applied to the container.

Although the retort process is an efficient sterilization process, it is harsh on packaging materials because of the temperature and pressure variations involved. Materials commonly used for stand-up, reclosable containers, such as plastic bottles, tend to soften and distort during retort processing. Materials used for seals can soften and, because the seal material is distinct from the container material, can form small gaps or pinholes at the bond interface. These gaps or pinholes can allow product to vent out of the container as the internal pressure increases during the retort process and can allow process bath water to enter the container as the internal pressure decreases relative to the external pressure and the package returns to ambient conditions. Because the packaged beverage and the process water may pass through very small gaps at the bond interface, this event may occur even though the product appears to have an acceptable seal. Moreover, the container and seal may enter the retort process in a less than ideal condition because the process to adhere the seal to the container can cause the neck, the lip, the threads or a combination thereof on the container to distort slightly. If the seal is transferred to the neck with a closure mounted on the container, the skirt, top, threads or a combination thereof on the closure may distort during the seal transfer process. These material failures can increase the number of manufacturing errors and can allow for product contamination even on packages that appear to meet quality standards.

Barrier pouches minimize the risk of material failures during retort processing because the pouch usually has sufficient flexibility that it can alter its shape in response to the overpressure conditions of the retort process. Moreover, barrier pouches generally have minimal headspace within the sealed pouch so the packages are less affected by the external pressure changes than are packages with relative large headspaces, such as semi-rigid bottle-like containers. Further, the seals or bonds are created by melding the pouch material to itself thereby creating strong, non-distinct bonds. Hence, well-sealed packages which are not dependent on maintaining their original shape can be produced. However, the pouches usually require specialized devices, such as sharp-tipped straws, to open the package and do not allow the consumer to reclose the package after opening.

For bottles or similar stand-up containers that are sealed such that the seal can withstand the retort process, a different problem may be created. The seal may adhere so tightly to the container lip that when the consumer attempts to remove the seal, the seal may be very difficult to remove from the container, and/or may tear into small pieces and leave fragments along the container rim. If the product is a beverage or similar liquid product, the product may settle under the seal fragments as the beverage is dispensed. This can make the product aesthetically unacceptable and unpleasant for repeated use by the consumer and increase the probability of bacterial contamination under the seal fragments. Further, the user risks being cut or scratched by the remaining foil bits along the container lip. Semi-rigid containers also have relatively large headspaces thereby allowing the user to shake and remix the product immediately before dispensing. However, during retort processing, the air-filled headspace will be affected more rapidly than the liquid product by the temperature changes increasing the pressure against the seal and thereby increasing the probability of seal failure.

SUMMARY OF THE INVENTION

The present invention is for a closure for a container that has a peelable seal wherein the sealed container is sterilized using a retort process. The closure provides a means for maintaining an effective pressure against the seal to prevent seal separation or leakage as the sealed container is subjected to the temperature and pressure deviations of the retort process.

Specifically, the closure includes a resilient liner and a skirt with at least one thread affixed to the skirt interior surface. The liner fits firmly within the closure, defines a resting thickness "t" at ambient temperature and pressure conditions, and is made from a material capable of being compressed to a thickness less than the resting thickness "t" and of recovering to a thickness sufficient to maintain an effective pressure between the closure and the peelable seal affixed to the container. In an embodiment of the present invention, the liner is made from a material capable of being compressed to a thickness less than the resting thickness "t" and of recovering to a thickness not greater than the resting thickness "t". In an alternative embodiment of the present invention, the liner is made from a material capable of being compressed to a thickness less than the resting thickness "t" and of recovering to a thickness which may be greater than the resting thickness "t". Also, in an embodiment of the present invention, the thread defines an angle θ between the upper edge and a horizontal plane and the angle θ is less than about 45°.

DETAILED DESCRIPTION OF THE INVENTION

The present invention is for a closure for a container that has a peelable seal wherein the sealed container is sterilized using a retort process. The closure provides a means for maintaining an effective pressure against the seal to prevent seal separation or leakage as the sealed container is subjected to the temperature and pressure deviations of the retort process. The closure and container depicted in the various Figures is selected solely for the purpose of illustrating the invention. Other and different closures, containers, or combinations thereof, may utilize the inventive features described herein as well.

Figure 1:
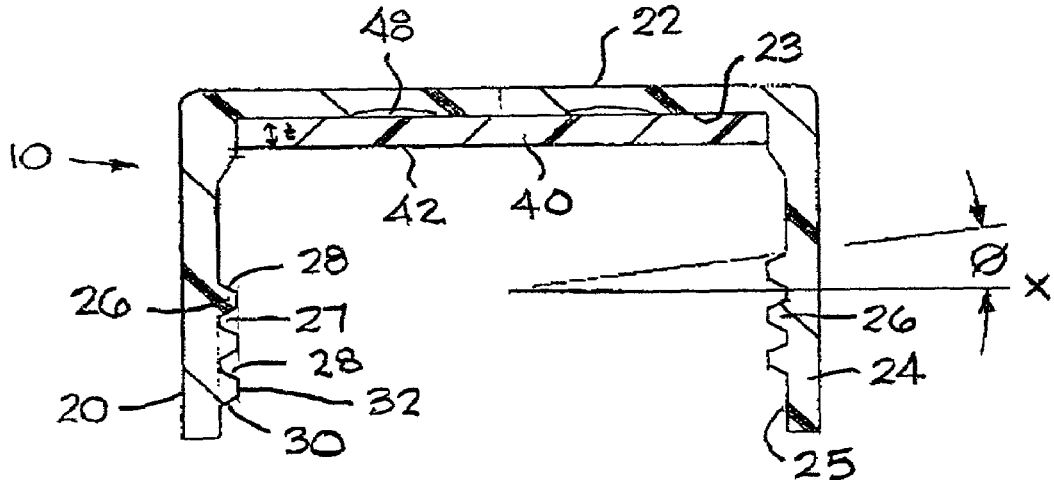
FIG. 1 is a sectional view of a closure made in accordance with the present invention.

Reference is first made to FIGS. 1-4 in which a closure constructed in accordance with the present invention is generally noted by the character numeral 10. The closure 10 includes a cap 20 and a liner 40. As generally shown in FIG. 1, the cap 20 includes a top 22, a skirt 24 depending from the top 22, and at least one thread 26. The top 22 and skirt 24 have interior surfaces 23 and 25, respectively. The thread 26 is affixed to the interior surface 25 of the skirt 24, circumscribing the skirt 24 in a spiral such that a depression or thread receiving groove 27 is formed. The thread 26 defines an upper edge 28, a lower edge 30 and a face 32. As is known in the art, the upper edge 28 and lower edge 30 are angled from a horizontal plane "X" causing the thread 26 to have beveled edges rather than sharp corners at the face 32, and allowing the thread 26 to be optimized for strength, cooling and material usage. In the closure 10 of the present invention, the angle for the upper edge 28 is preferably relatively close to horizontal. For example, an angle θ defined between the horizontal plane X and the upper edge 28 is not greater than about 45°, and preferably is less than about 20°. In the embodiment shown, the angle θ is about 10°.

Figure 4:
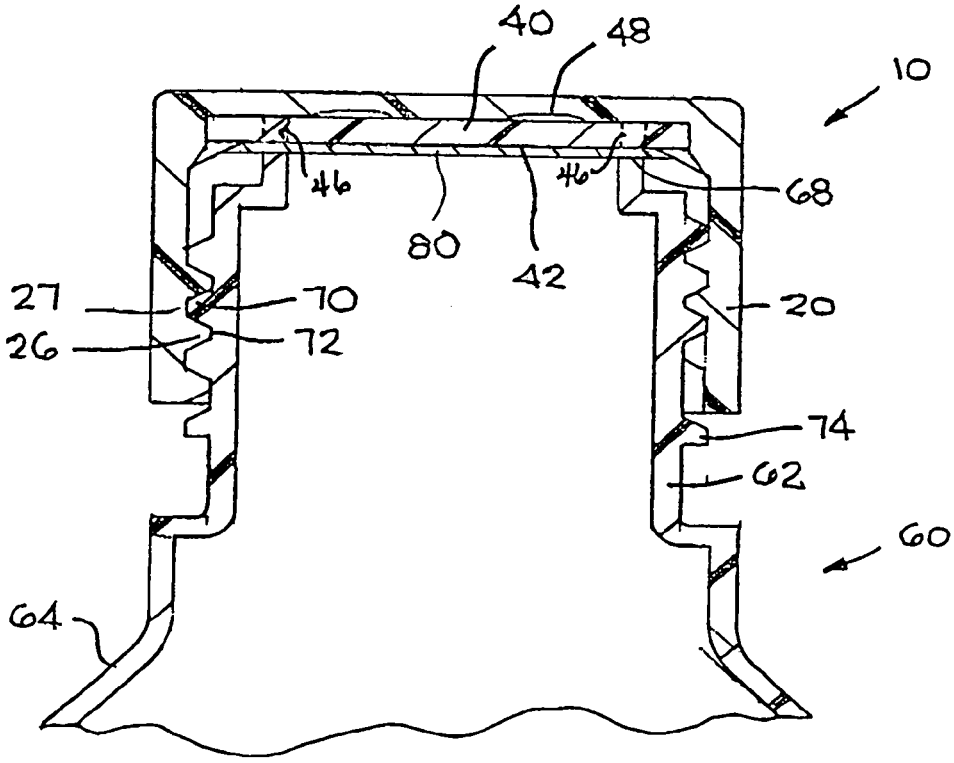
FIG. 4 is a sectional view of the closure of FIG. 1 shown with the container of FIG. 2 in a normal fully inserted position.

The liner 40 abuts the top interior surface 23 of the cap 20 and is sized to fit firmly within the cap 20, i.e., the diameter of the liner 40 is large enough that the liner 40 can be held within the cap 20 by the thread 26 without the need for a bonding material. Optionally, as shown in FIGS. 1 and 4, the liner 40 may be adhered to the top surface 23 by a variety of means known in the art, such as with a thin layer of adhesive, thermoplastic polymeric material, glue or similar bonding material 48. Combinations of bonding material layers may be used as desired by the user. The liner 40 defines a resting thickness, "t", which is the unrestrained thickness of the liner 40 at ambient temperature and pressure conditions. The material selected for the liner 40 should be sufficiently pliable or elastic that the liner 40 can be compressed between the cap 20 and a container 60, thereby decreasing the liner thickness "t". But, the liner 40 material should also be sufficiently resilient that the material can recover from the compressed state to define a recovery thickness, "$t_r$", at ambient temperature and pressure conditions or under stress temperature and pressure conditions, such as are present during a retort process. The recovered thickness of the liner 40, $t_r$, may be essentially equal to, less than, or greater than the resting thickness, t. The recovery thickness, $t_r$, should be sufficient to allow the liner 40 to maintain a positive pressure against the cap 20 and a seal 80 affixed to a container lip 68, wherein the pressure is adequate to prevent the seal 80 from separating from the container 60. To maintain the pressure against the seal 80, the liner 40 should have sufficient elasticity that it can conform to any distortions in the container lip 68, such as molding nubs or small divots or voids. For example, the liner 40 may be made from a thermoplastic or a thermoset material such as a silicone-based material, urethane, latex, rubber, a thermoplastic elastomeric material such as Santoprene®, or a combination thereof. Optionally, the liner 40 may be made from a material having a melting point greater than the anticipated maximum retort processing temperature, such as about 265° F., and having a shore A value of about 70. To enhance the expansion capabilities of the material, the liner 40 material may also include foaming agents, entrapped or encapsulated gases or similar expanding agents. Because the liner 40 is in direct contact with the seal 80, the materials selected for the liner 40 should not bond to the seal 80.

Figure 2:
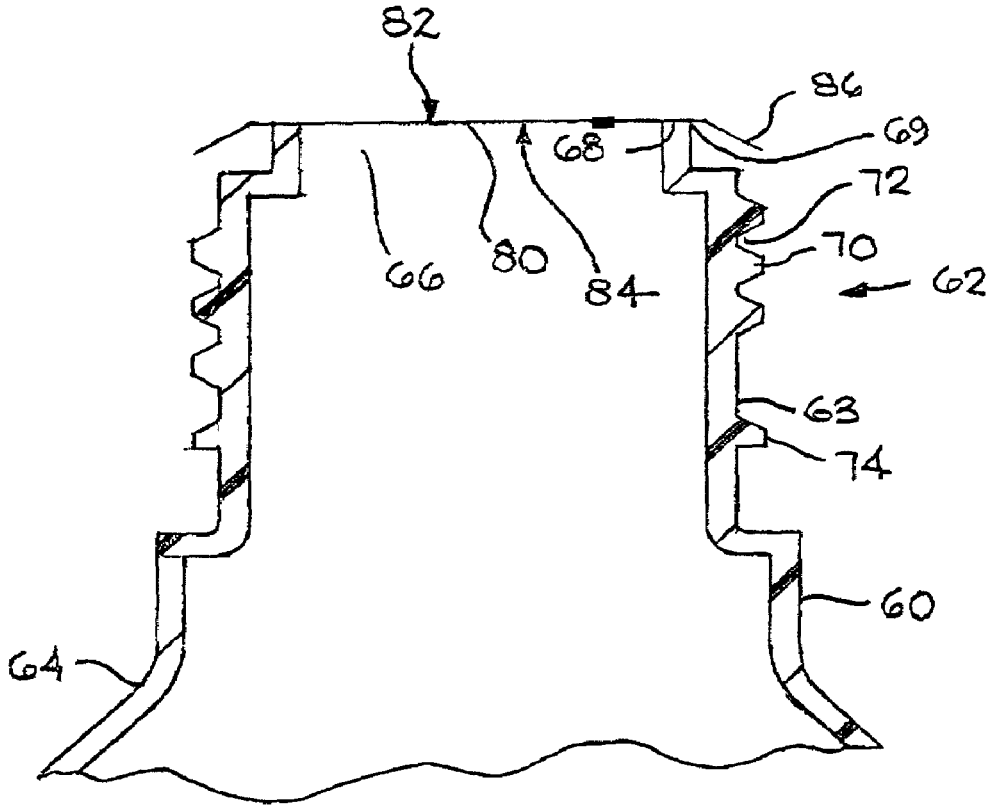
FIG. 2 is a sectional view of a container with a seal amenable for use with the closure of FIG. 1.
Figure 3:
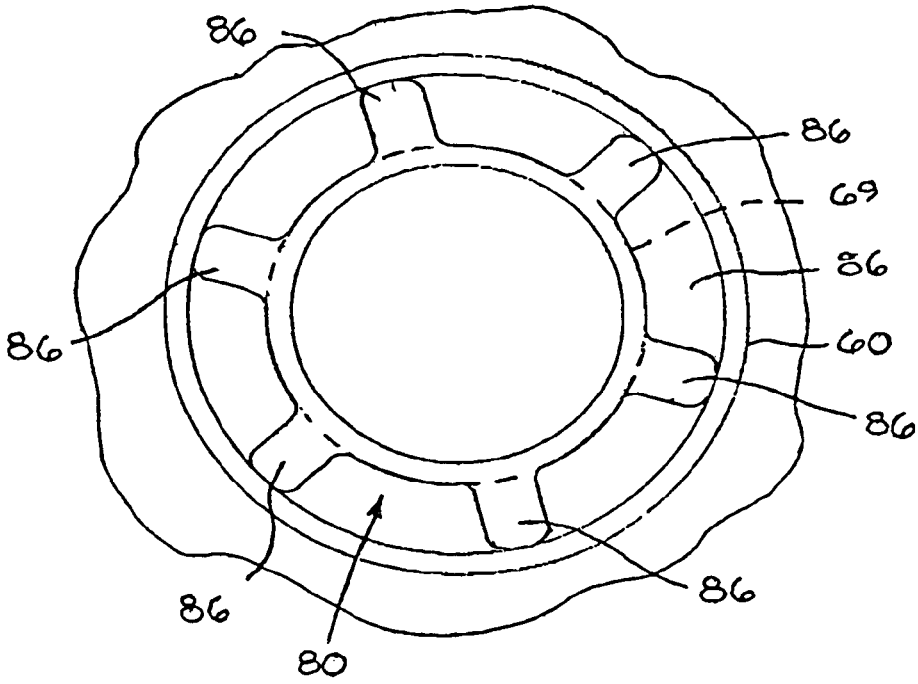
FIG. 3 is a top view of the container of FIG. 2 with a seal on top.

The closure 10 is designed to function cooperatively with the container 60 having the removable seal 80. As shown in FIGS. 2-4, the container 60 has a neck 62 which extends vertically from shoulders 64 and terminates in an opening 66, defining the lip 68 having a periphery 69. As shown in FIGS. 2 and 3, the neck 62 has an exterior face 63 adapted to allow the container 60 to receive and engage the cap 20. The engaging face 63 includes a container thread 70 fixedly attached to the engaging face 63, and a thread receiving groove 72. The thread 70 may have one of a variety of thread configurations, such as a single helix (1 strand), a double helix (2 strands), a triple helix (3 strands) or other multiple helices, as are known in the art. Optionally, the neck 62 may include a bottle bead or collar 74. The bottle bead 74 is an annular projection located near the shoulder portion 64 of the container 60 and encircling the neck 62. The container 60 may be manufactured from a variety of materials as are known in the art for container use. Preferably, the container 60 is made of a rigid or semi-rigid polymeric material which can withstand retort processing conditions.

The seal 80 has a top face 82 and a container face 84. The seal 80 is reversibly affixed to the container lip 68, and preferably, is affixed to the lip 68 such that the seal 80 can be completely removed from the lip 68 by the user without tearing, shredding or leaving consumer noticeable fragments on the container lip 68. As is known in the art, the seal 80 may be proportioned to match the periphery 69 of the container neck 62, or it may be proportioned to extend beyond the periphery 69 thereby partially covering the exterior face of the neck 62, or it may be proportioned to match the periphery 69 in some sections and to extend beyond the periphery 69 at other sections, such as by including one or more tabs 86. The seal 80 preferably has sufficient strength and elasticity to allow the seal 80 to conform to the container lip 68 while accommodating any distortions, such as molding nubs or small voids or divots, and to expand and contract in the retort process without rupturing. Further, the seal 80 preferably can be adhered to the container lip 68 to form a semi-permanent bond between the seal 80 and container 60.

In the embodiment shown in FIGS. 1 and 4, the closure 10 is reversibly attached to the container 60 after the container 60 is filled and has the seal 80 affixed to the container lip 68. The container contents are then sterilized with retort processing. In a typical process, the filled package is transported through a high pressure overheated water bath, wherein the package is heated to from about 75° F. to about 265° F. for a predetermined period of time. As the exterior surface of the package is heated, the package contents are heated and the internal (vapor) pressure increases. Concurrently, the package is submerged to greater depths in the water bath resulting in a counteracting external pressure increase. The package is then slowly raised—moved to a more shallow depth—as the package is concurrently transported into a cooler zone in the water bath. The rate of movement into the cooler zone and shallower depth is designed to minimize variations in the internal pressure of the package. After a predetermined time, the package is removed from the water bath and allowed to cool to room temperature.

As shown in FIG. 4, the closure 10 functions cooperatively with the container 60 and seal 80 to provide an added measure of protection for the seal integrity as the container contents are sterilized by the retort process. Specifically, the closure 10 fits over the container neck 62 and the cap thread 26 complements the container thread 70 with the cap thread 26 fitting within the container receiving groove 72 and the container thread 70 fitting within the cap receiving groove 27. Further, the cap 20 and the liner 40 are proportioned such that when the container 60 is fully inserted in the closure 10, a bottom face 42 of the liner abuts the seal 80. In the embodiment shown in the Figures, the cap thread 26 and the container thread 70 are single helices, but any complementary thread design may be used provided the thread design can withstand the processing conditions.

During the retort process, the liner 40 functions cooperatively with the cap 20 to provide a pressure against the seal 80 opposing the container lip 68. Specifically, when the closure 10 is attached to the sealed container 60 at ambient temperature and pressure conditions, the cap 20 may be tightened on the container 60 such that the liner 40 is compressed slightly between the container lip 68 and the top interior surface 23 of the cap 20. A sealing zone 46, shown in FIG. 4, is thereby formed where the seal 80 and liner 40 are sandwiched between the cap 20 and the container lip 68. When the closure 10 and sealed container 60 are exposed to the retort conditions, the seal integrity is challenged by pressure increases within the container 60. With the liner 40 pressing the seal 80 against the container lip 68, the probability of the seal 80 separating from the container lip 68 as the pressure changes within the container 60 is minimized. Further, when the closure 10 and sealed container 60 are exposed to the high pressure retort conditions, small droplets of water from steam or the water bath may attempt to migrate into any void spaces that are present between the container 60 and the closure 10 because of the increased pressure outside the container 60. By forming a tight barrier between the top interior surface 23 of the cap 20 and the top face 82 of the seal, the liner 40 can minimize the risk of water droplets migrating between the cap 20 and the seal 80.

During the retort process, the angle θ of the cap and closure threads 26, 70 functions to hold the closure 10 on the container 60. Because of the pressure changes in the container associated with the retort process, the container may be distorted, and the distortion can affect the interaction of the container threads 70 with the cap threads 26. Threads with an essentially horizontal angle θ are stronger than threads having a larger angle θ. As the thread strength increases, the probability of the threads stripping and loosening decreases. Thus, because the threads of the closure 10 have a relatively small angle θ, the closure 10 is held securely on the container 60 and the liner 40 is held against the seal 80.

The closure 10 may remain on the container 60 until removed by the consumer. Optionally, the closure 10 may be removed from the container 60, the exterior surface of the neck 63 may be dried, for example with heated air, and a commercial closure may be applied. The commercial closure may be essentially identical to the closure 10, it may include tamper-evident features, or it may include other consumer-desired or aesthetic features, as are known in the art. However, small droplets of water can migrate under pressure from the water-bath into any void spaces that are present between the container 60 and the closure 10 during the retort process. Thus, if the closure 10 is to remain on the container 60 after processing, the closure 10 is preferably adapted to allow water to drain from spaces between the closure 10 and the container 60.

Figure 5:
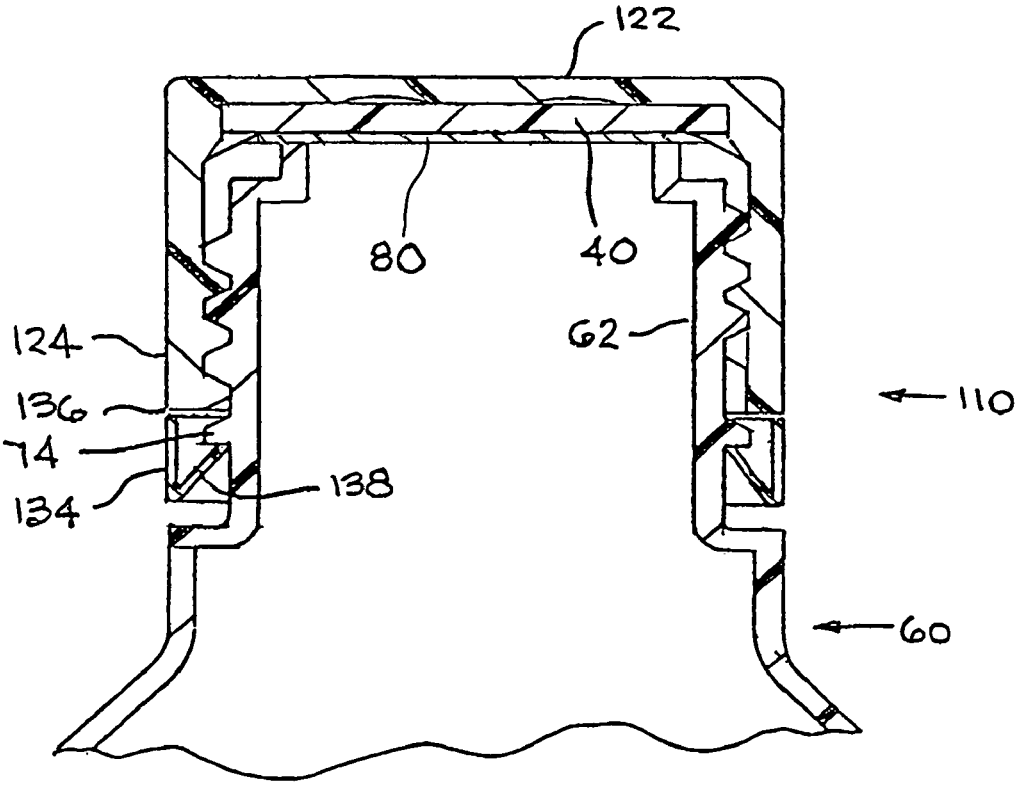
FIG. 5 is a sectional view of an alternative embodiment of a closure made in accordance with the present invention having a plurality of folding fingers as the engaging means for the tamper-evident band.
Figure 6:
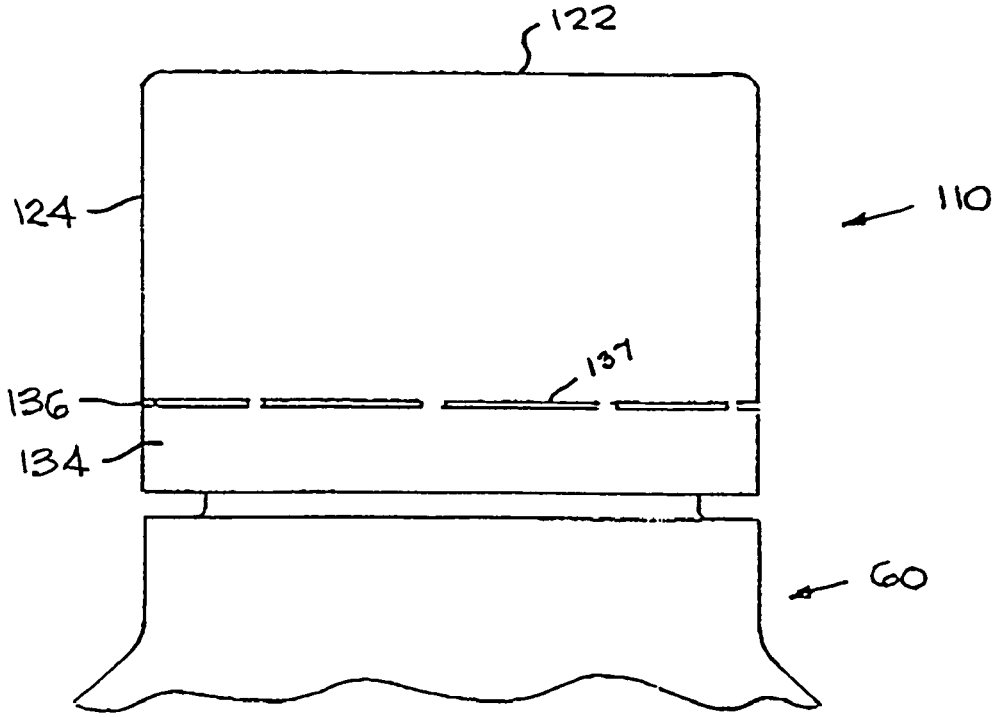
FIG. 6 is a side view of the closure of FIG. 5.

As shown in FIGS. 5 and 6, an alternative embodiment of the closure 110 is intended to be attached to the container 60 before retort processing and to remain on the container 60 until removed by the consumer. The closure 110 is essentially identical to the closure 10 except that a skirt 124, depending from a top 122, terminates with an essentially circular tamper-evident band 134. The tamper-evident band 134 can be similar to any known tamper-evident or child-resistant band provided the band includes some void areas which would allow water droplets to drain from the band. In the embodiment shown, the tamper-evident band 134 includes a break-away section 136 and a means 138, such as flexible finger projections, for positively engaging the collar 74. As is known in the art, the flexible finger projections include spaces between the fingers which allow any trapped water to drain from the band 134. In addition, some water drainage may be provided through apertures 137 in the break-away section 136.

Figure 7:
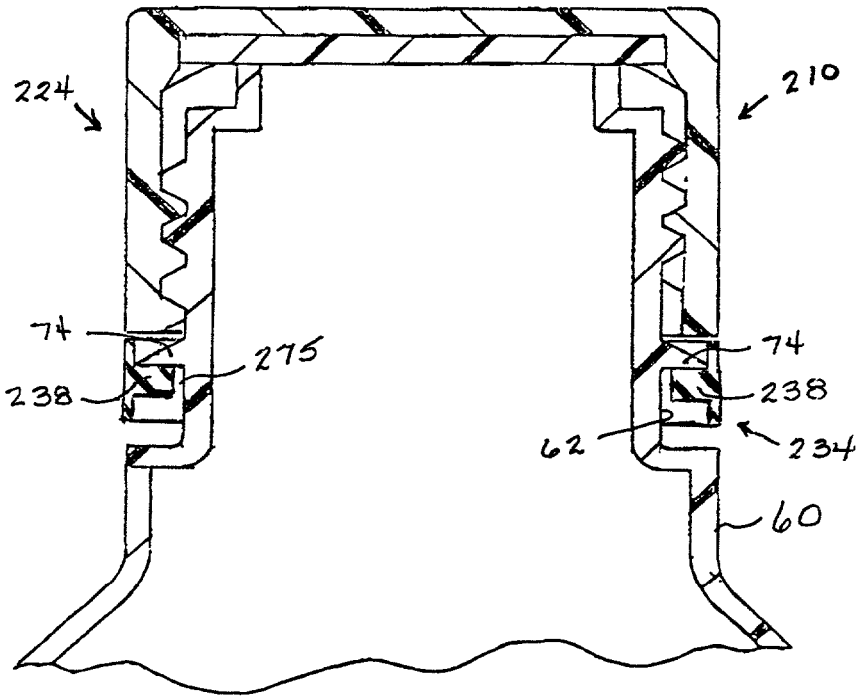
FIG. 7 is a sectional view of a second alternative embodiment of a closure made in accordance with the present invention and having a continuous band as the engaging means for the tamper-evident band.
Figure 7A:
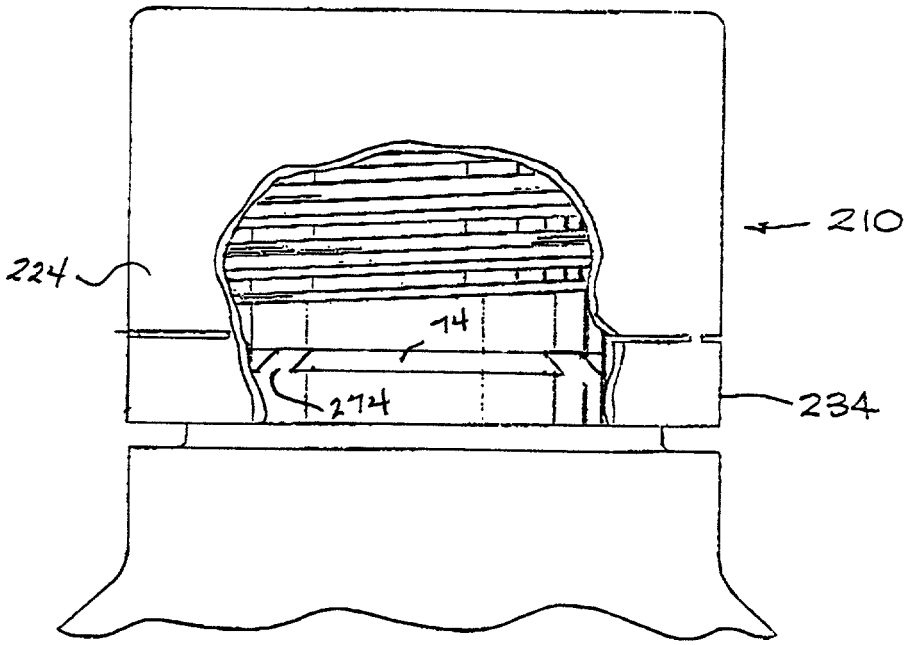
FIG. 7A is a cut-away view of the closure of FIG. 7 showing the segmented bottle bead.

A second alternative embodiment 210 of a closure with a tamper-evident band 234 is shown in FIGS. 7 and 7A. The closure 210 is similar to the closure 110 of FIG. 5 except that the means for positively engaging the collar 74 is a bead 238 encircling the skirt 224. The bead 238 has an internal diameter slightly greater than the external diameter of the exterior surface of the container neck 63 so that a gap 275 remains between the bead 238 and the neck exterior surface 63. Additionally, optional gaps or breaks 274 are preferably included in the container collar 74 to allow water droplets to drain from band 234 and to improve the air circulation between the skirt 224, band 234 and the container neck 62.

Figure 8:
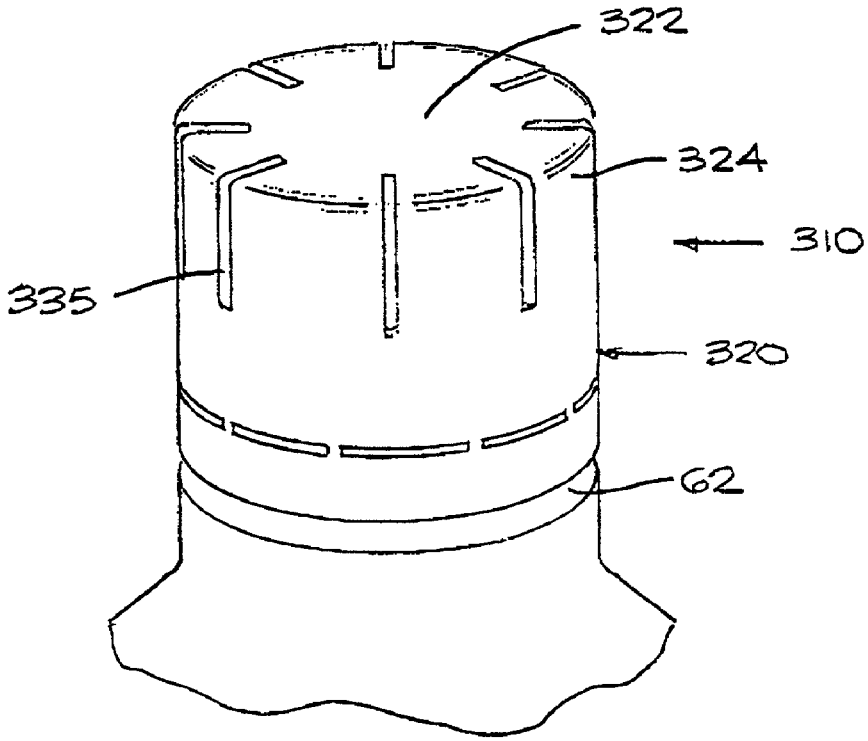
FIG. 8 is a side view of the closure of FIG. 5 having a slotted skirt.

FIG. 8 shows a third alternative embodiment of the closure 310 which allows for air circulation between the container neck 62 and the cap skirt 324. The closure 310 of FIG. 8 is identical to the closure 110 of FIG. 5 except that ventilation slits 335 have been added to the cap 320 running a predetermined length from the top 322 to the skirt 324. The slits 335 may extend a slight distance onto the top 322 but may not breach the sealing zone 46. The slits 335 allow air to circulate between the container neck 62 and the skirt 324. The number and precise positioning of the slits can vary as necessary for the particular container/closure combination.

Figure 9:
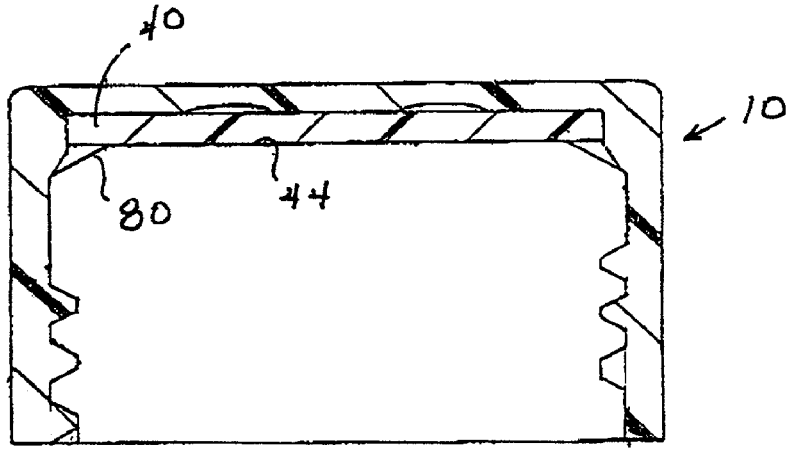
FIG. 9 is a sectional view of the closure of FIG. 1 shown with a seal affixed to the liner.

As described in the embodiments of FIGS. 1-8, the seal 80 is secured to the container lip 68 before the closure 10 is affixed to the container 60. However, as shown in FIG. 9, the seal 80 may be delivered to the container 60 via the closure 10. For example, the seal 80 may be included as a transferable part of the liner 40, wherein the seal 80 is reversibly secured to a bottom face 44 of the liner 40. Using the embodiment of FIG. 9, the closure 10 may be reversibly attached to the container 60 such that the seal 80 abuts the container lip 68. The seal 80 can then be secured to the container lip 68 and released from the liner 40 using known heat-sealing techniques, such as induction heat sealing or conduction heat sealing. After the seal 80 has been affixed to the container lip 68, the closure 10 can be removed from the container 60 with the liner 40 remaining in the closure cap 20 and the seal 80 remaining on the container 60. The seal 80 is preferably transferred from the liner 40 to the container lip 68 before the container 60 is subjected to the retort processing conditions. The retort process then proceeds as described for the embodiment shown in FIGS. 1-4.

From a reading of the above, one with ordinary skill in the art should be able to devise variations to the inventive features described herein. These and other variations are believed to fall within the spirit and scope of the attached claims.

What is claimed is:

1. A retort capable closure in combination with a container comprising:

a. a container having a neck with a lip defining an opening therein, and a peelable seal covering said opening;

b. a closure having a top with an interior surface and a skirt depending from the top and defining a skirt interior surface;

c. at least one thread affixed to the skirt interior surface and circumscribing the skirt in a spiral such that a thread receiving groove is formed, said thread having an upper edge wherein an angle Θ is defined between the upper edge and a horizontal plane, and the angle Θ is less than about 45°;

d. a liner being made of at least a portion of vulcanized rubber and a portion of polypropylene, said liner being free from foaming agents, said liner proportioned to fit firmly within said closure and abutting the top interior surface thereof, said liner defining a resting thickness at ambient temperature and pressure conditions, and said liner being made from a material capable of being compressed to a thickness less than the resting thickness and being capable of recovering to a recovery thickness sufficient to allow said liner to maintain a positive pressure against said cap and against said seal when said cap is affixed to said container and the internal pressure of said container is raised above 0 psi and said container internal temperature is raised to above 212° F. wherein said liner maintains sufficient pressure on said peelable seal to prevent said seal from disengaging said lip during a retort operation.

* * * * *